US005443696A

United States Patent [19]

Baird et al.

[11] Patent Number: 5,443,696

[45] Date of Patent: Aug. 22, 1995

[54] COKE OVEN DOOR

[75] Inventors: William R. Baird; Billy C. Baird, both of Sturgis, Ky.

[73] Assignee: Saturn Machine & Welding Co., Inc., Sturgis, Ky.

[21] Appl. No.: 808,960

[22] Filed: Dec. 13, 1991

Related U.S. Application Data

[63] Continuation of Ser. No. 700,031, May 7, 1991, abandoned, which is a continuation of Ser. No. 82,205, Aug. 6, 1987, abandoned.

[51] Int. Cl.[6] ..... C10B 25/02

[52] U.S. Cl. ..... 202/248; 110/173 R; 202/269

[58] Field of Search ..... 202/242, 248, 268, 269; 49/480, 483–485; 110/173 R

[56] References Cited

U.S. PATENT DOCUMENTS

| | | | |
|---|---|---|---|
| 4,115,203 | 9/1978 | Naevestad | 202/248 |
| 4,186,055 | 1/1980 | Baird et al. | 202/248 |
| 4,263,101 | 4/1981 | Thiersch et al. | 202/248 |
| 4,426,259 | 1/1984 | Hendrych | 202/248 |
| 4,427,494 | 1/1984 | Naevestad | 202/248 |

*Primary Examiner*—W. Gary Jones

*Attorney, Agent, or Firm*—Wood, Herron & Evans

[57] ABSTRACT

Coke oven doors and more particularly coke oven doors having a unique and novel spring arrangement for maintaining the knife edge of the sealing element in sealed relation to the face of the coke oven door jamb, an improved sealing arrangement at the leveler door, scalloped cutouts in the main frame components to increase efficiency of heat dissipation, a manual adjustment structure incorporated into the main door frame to provide more positive and controlled flexibility of the main door frame and the provision of cuts in the door frame and the manner in which the diaphragm plate is connected to the refractory to provide space for the door frame to flex when adjustments are made.

11 Claims, 5 Drawing Sheets

COKE OVEN DOOR

This application is a continuation of application Ser. No. 07/700,031, filed May 7, 1991, which is in turn a continuation of application Ser. No. 07/082,205, filed Aug. 6, 1987, both of which are abandoned.

BACKGROUND OF THE INVENTION

FIELD OF THE INVENTION

The present invention generally relates to coke oven doors and more particularly to coke oven doors having a unique and novel spring arrangement for maintaining the knife edge of the sealing element in sealed relation to the face of the coke oven door jamb, an improved sealing arrangement at the leveler door, scalloped cutouts in the main frame components to increase efficiency of heat dissipation, a manual adjustment structure incorporated into the main door frame to provide more positive and controlled flexibility of the main door frame and the provision of cuts in the door frame and the manner in which the diaphragm plate is connected to the refractory to provide space for the door frame to flex when adjustments are made.

INFORMATION DISCLOSURE STATEMENT

Our prior U.S. Pat. No. 4,186,055 issued Jan. 29, 1980 for Coke Oven Door discloses the most relevant prior art known to applicants and the disclosure in that patent as well as the prior patents discussed in that patent and the prior art made of record in that patent are incorporated herein. U.S. Pat. No. 4,186,055 discloses in detail coke oven structures including the pusher side door which has a small leveler door incorporated therein and the coke side door which does not include any other openings. As indicated in that patent, various problems have been encountered relating to maintaining a proper seal between the coke oven door jamb face and the coke oven door. These problems have been recognized in various other prior patents in addition to U.S. Pat. No. 4,186,055 and the structures disclosed in the prior patents have to some extent provided at least partial solutions to the ongoing problem of maintaining proper sealing contact between the coke oven door and the coke oven door jamb face.

SUMMARY OF THE INVENTION

An object of the present invention is to provide a coke oven door having an improved spring assembly for maintaining the sealing element of the coke oven door in sealing contact with the face of the coke oven door jamb.

Another object of the invention is to provide a coke oven door utilizing a novel spring assembly for maintaining the sealing arrangement for the leveler door incorporated into the main coke oven door in which the spring arrangement is similar to the spring arrangement for maintaining the sealing element of the main coke oven door in sealing contact with the coke oven door jamb when the main door is in closed position.

A further object of the invention is to provide a coke oven door in accordance with the preceding object in which side plate components of the door are provided with scalloped cutouts for more efficient heat dissipation by increasing the surface area in heat exchange contact with ambient air.

Still another object of the invention is to provide a coke oven door in accordance with the preceding objects in which the coke oven door is provided with a main frame having flexibility incorporated therein to enable the door to conform with the door jamb with the flexibility of the main frame being manually adjusted thereby providing a more positive and controlled method of obtaining flexibility in the main door frame.

A still further object of the invention is to provide an improved connection between the diaphragm plate in the coke oven door and the refractory in order to provide a space therebetween to allow the door to flex when manual adjustments are made to the main door frame.

These together with other objects and advantages which will become subsequently apparent reside in the details of construction and operation as more fully hereinafter described and claimed, reference being had to the accompanying drawings forming a part hereof, wherein like numerals refer to like parts throughout.

DESCRIPTION OF THE PREFERRED EMBODIMENTS

Figure 1:
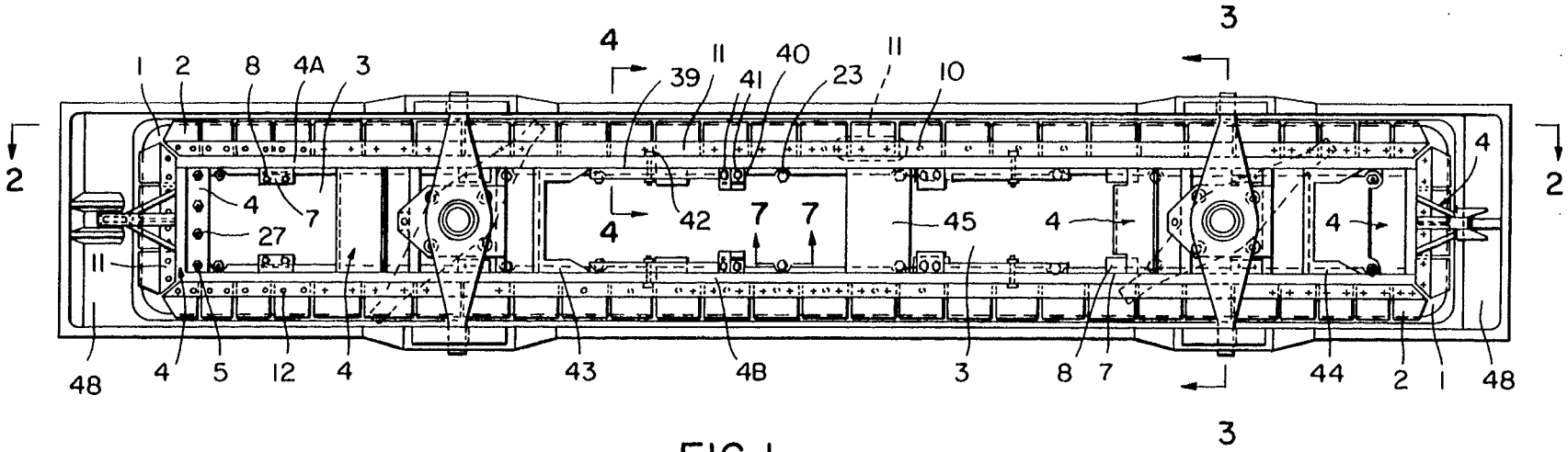
FIG. 1 is a front elevational view of the coke oven door of the present invention.

Referring now specifically to the drawings, FIGS. 1–8 disclose a coke side oven door and FIGS. 9–12 disclose a pusher side coke oven door according to the present invention and in association with an oven door jamb of a conventional coke oven. Both embodiments of the door are similar with the pusher side door illustrated in FIGS. 9–12 including a leveler door assembly. In both embodiments, the door consists primarily of a diaphragm plate 3 having a main frame weldment 4 peripherally of the plate 3, a diaphragm sealing edge 1 peripherally of the plate 3 and a diaphragm leaf spring 2 maintaining the sealing edge 1 against the face 49 of the coke oven door jamb 48.

The diaphragm leaf spring 2 replaces items 20, 42, 44 and 46 in U.S. Pat. No. 4,186,055 and provides all of the functions of the previous structure into a single leaf spring 2 in order to provide the effectiveness of the contact of the diaphragm sealing edge 1 with the face 49 of the door jamb 48.

Figure 13:
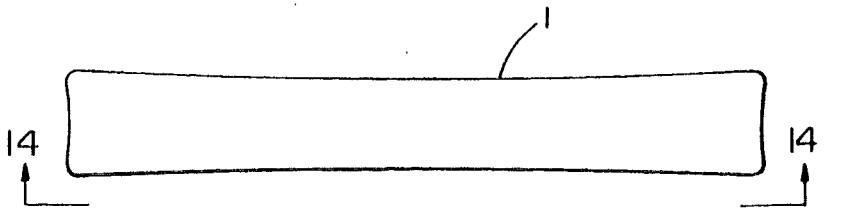
FIG. 13 is a schematic plan view of the diaphragm sealing edge.
Figure 14:
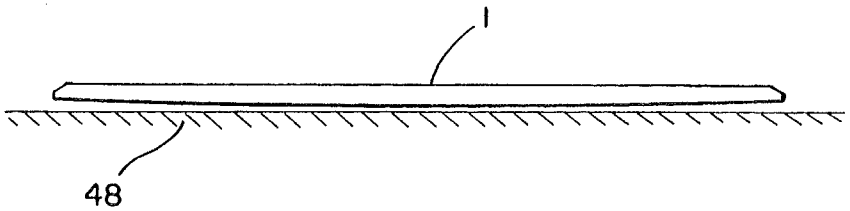
FIG. 14 is a schematic elevational view taken along reference line 14—14 on FIG. 13.

As illustrated in FIGS. 13 and 14, the improved leaf spring 2 and its relationship to the diaphragm sealing edge 1 illustrate the concept of operation for the improved leaf spring and sealing concept. The leaf springs 2 are formed and heat treated to provide an even distribution of sealing pressure all around the sealing edge 1 with FIG. 13 illustrating a schematic plan view and FIG. 14 a schematic side view of the sealing edge 1 in a relaxed position, that is, with no downward pressure being exerted. FIG. 13 illustrates the sealing edge 1 to be hourglassed in configuration and FIG. 14 shows a downward bow of the sealing edge 1. Both the hourglass effect and downward bow are caused by the tension of the leaf springs 2 at point 2A which squeezes in and pushes down the sealing edge 1 between the corners which are rigid. Thus, when the door is installed on a jamb, the seal edge 1 will first make contact with the face 49 of the jamb 48 at a point half-way between the corners. Therefore, once the sealing edge at the four corners make contact with the face of the jamb, then a complete peripheral seal is obtained.

The leaf spring 2 provides a uniform and even distribution of pressure on the sealing edge 1 inasmuch as portion 2A, due to its less width than member 44 of U.S. Pat. No. 4,186,055, provides greater inward and downward tension on the sealing edge 1 thereby providing a more effective seal with the door jamb. Also, the leaf springs 2 provide, in effect, a flue for the dissipation of heat between the sealing edge 1 and the springs 2 when the door is installed in its vertical position on the door jamb 48.

Figure 2:
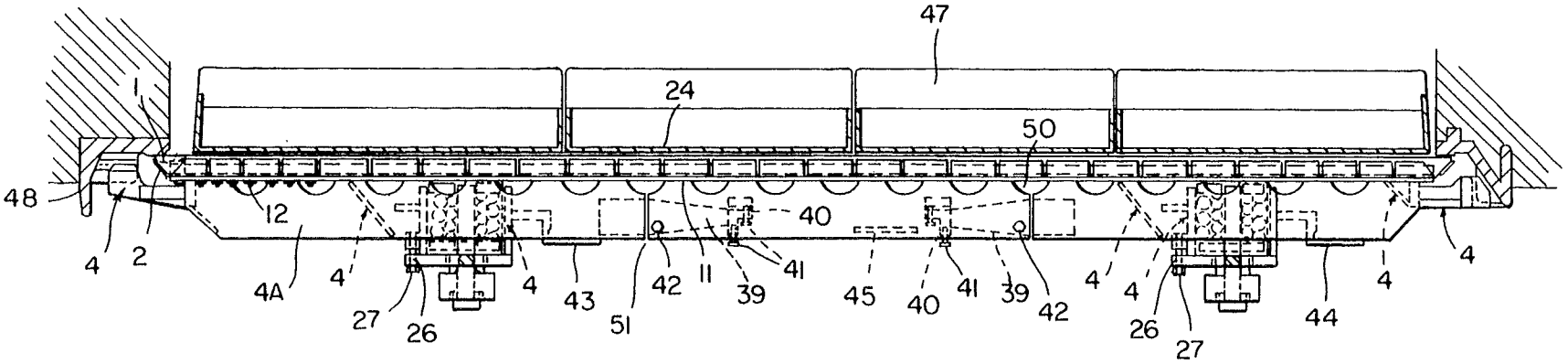
FIG. 2 is a longitudinal vertical sectional view taken substantially along section line 2—2 on FIG. 1.
Figure 3:
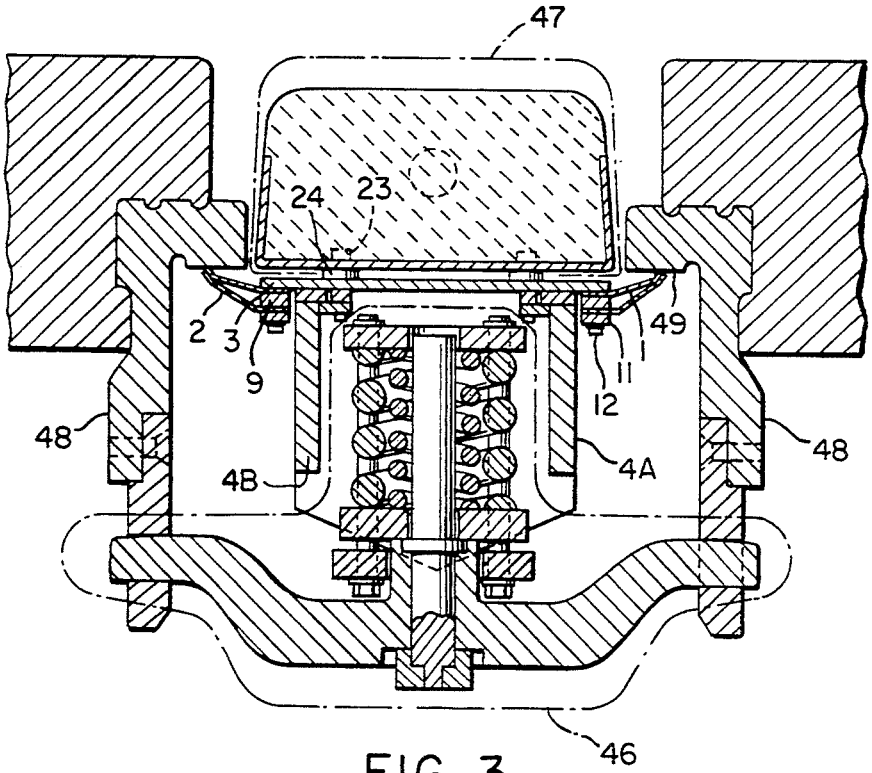
FIG. 3 is a sectional view, on an enlarged scale, taken generally along section line 3—3 on FIG. 1.
Figure 4:
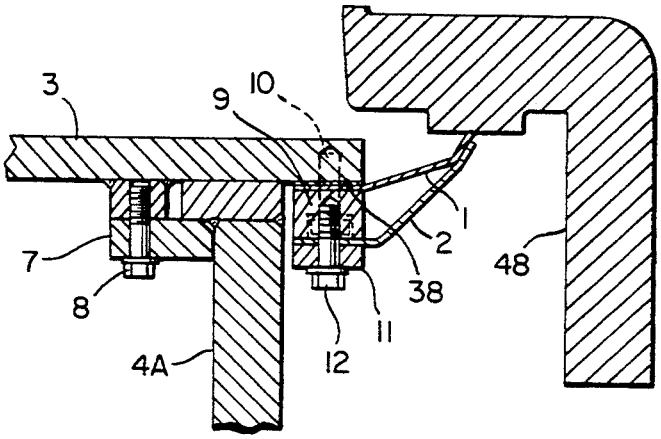
FIG. 4 is a sectional view, on an enlarged scale, taken substantially along section 4—4 on FIG. 1.

Another change and improvement in both embodiments of the door is the construction of the side plates 4A and 4B as illustrated in FIG. 3 which form part of the main frame weldment 4 and are provided with scalloped notches or cutouts 50, as illustrated in FIG. 2. These cutouts 50 serve to bleed off or dissipate heat from the main frame weldment 4 and from the diaphragm plate 3 thereby reducing distortion/warpage of the door frame.

Figure 7:
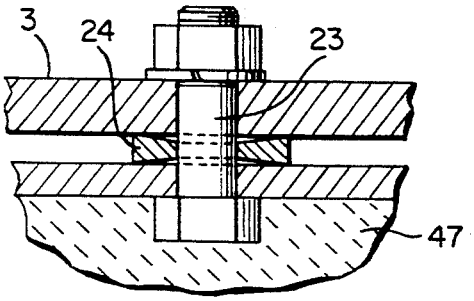
FIG. 7 is a sectional view, on an enlarged scale, taken substantially along section line 7—7 on FIG. 1 illustrating the connection between the diaphragm and refractory.

Both embodiments of the invention also have improved flexibility characteristics which replace components 68–76 as described in lines 49–58, col. 8 of U.S. Pat. No. 4,186,055 and include a main frame adjusting arm 39, as illustrated in FIGS. 1 and 2 and in FIG. 11. The adjusting arm 39 includes a main frame adjusting block 40, an adjusting bolt 41 and a locking bolt 42 to lock the main frame adjusting arm 39 in adjusted position. With this structure, rather than using an automatic spring adjustment as in the prior patent, a manual adjustment is provided which provides for a more positive and controlled method of varying the flexibility of the main door frame 4. An additional improvement relating to the flexibility of the door and contributing to the flexibility of the main door frame weldment 4, sectional cuts 51 are made in the main door frame weldment 4. Additionally, the diaphragm plate 3 is connected to the refractory 47 by bolts 23 with a fire ring 24 interposed therebetween. The fire ring 24 has a double taper or bevel from the outer periphery to the periphery of the center opening as illustrated in FIG. 7 in order to provide a space, approximately $\frac{1}{4}''$ between the diaphragm plate 3 and the refractory 47. The beveled fire ring 24 provides for a seal around the periphery of the bolt 23 and it also serves as a spacer between the diaphragm plate 3 and the refractory 47 thereby allowing sufficient space for the door to flex when adjustments are made to the main frame adjusting arm 39 without adversely affecting the connection between the diaphragm plate 3 and the refractory 47.

Figure 11:
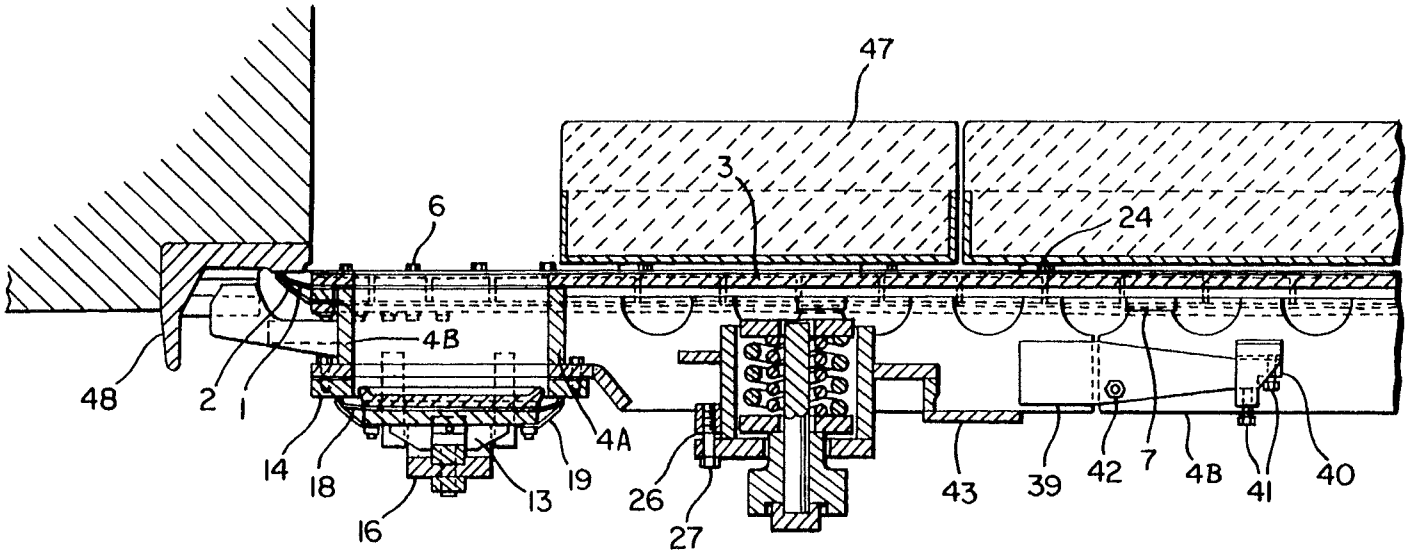
FIG. 11 is a sectional view taken along section 11—11 on FIG. 9 illustrating further structural details of the pusher side door and leveler door incorporated therein.
Figure 12:
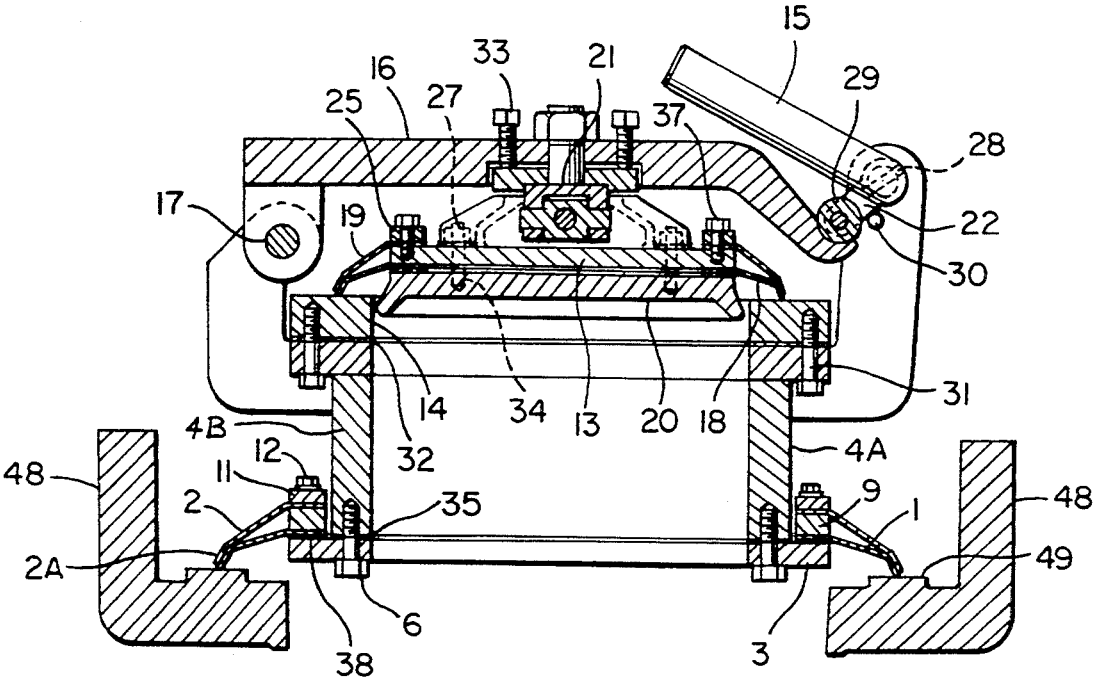
FIG. 12 is a detailed sectional view taken substantially upon section line 12—12 on FIG. 9 illustrating further structural details of the leveler door.

In the pusher side door, as illustrated in FIGS. 9–12, the same sealing concept is used at the leveler door as with the main door and includes a leveler door frame 13, sealing frame 14, opening handle 15, carrier bar 16, hinge pin 17, diaphragm sealing edge 18, diaphragm leaf spring 19, heat shield 20, trunnion 21 and cam lock 22 as illustrated in FIGS. 9–12. Thus, the diaphragm sealing edge 18 and diaphragm leaf springs 19 are similar to the corresponding structure in the main door. In the leveler door, trunnion adjusting bolts 33 cooperate with the leaf springs 19 to apply tension/pressure on the sealing edge thereby, in effect, utilizing the same sealing concept on the leveler door that is used on the main door. The leveler door heat shield 20, the leveler door trunnion 21 and the leveler door cam lock 22 are substantially the same as the structures illustrated in prior U.S. Pat. No. 4,186,055. The leveler door lock structure includes a diaphragm bar 25, threaded stud 26, nut 27, handle pin 28, cam lock roller 29, cam lock stop pin 30, frame bolt 31, frame gasket 32, adjusting bolt 33, threaded stud 34, diaphragm plate gasket 35, diaphragm gasket 36, diaphragm bar bolt 37 and main seal gasket 38 as illustrated in FIGS. 9–12 with FIG. 12 illustrating these details which are similar to these components illustrated in U.S. Pat. No. 4,186,055 except for the sealing edge 18 and springs 19 and related structure.

The coke oven door also includes an upper lifting lug 43 and a lower lifting lug 44 as illustrated in FIGS. 1 and 2 as well as a plate 45 having an identifying numerical indicia or other indicia thereon with the locking assembly 46 for the main door being the same as that disclosed in the prior patent.

Figure 8:
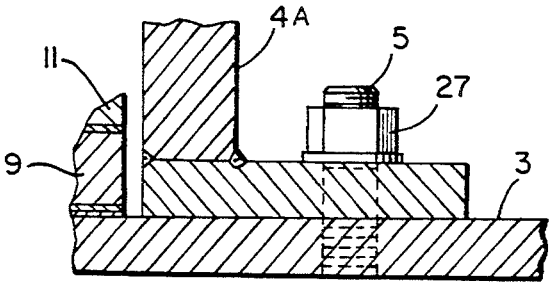
FIG. 8 is a sectional view taken substantially along section line 8—8 on FIG. 1 illustrating the connection of the main frame to the diaphragm plate.
Figure 9:
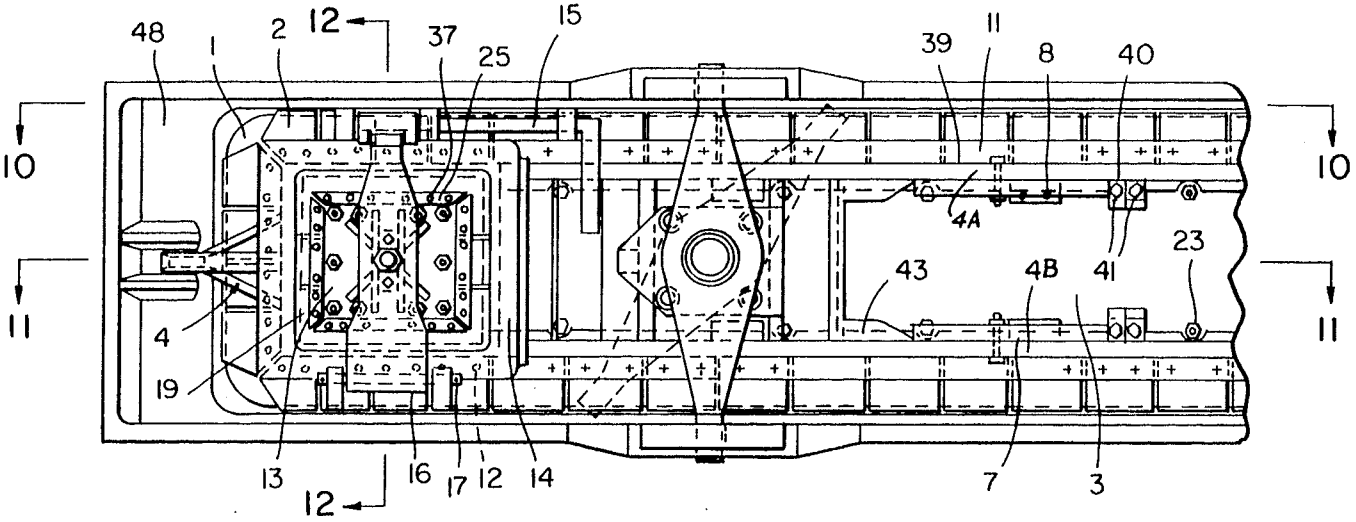
FIG. 9 is a partial elevational view of a pusher side coke oven door in which a leveler door is incorporated.
Figure 10:
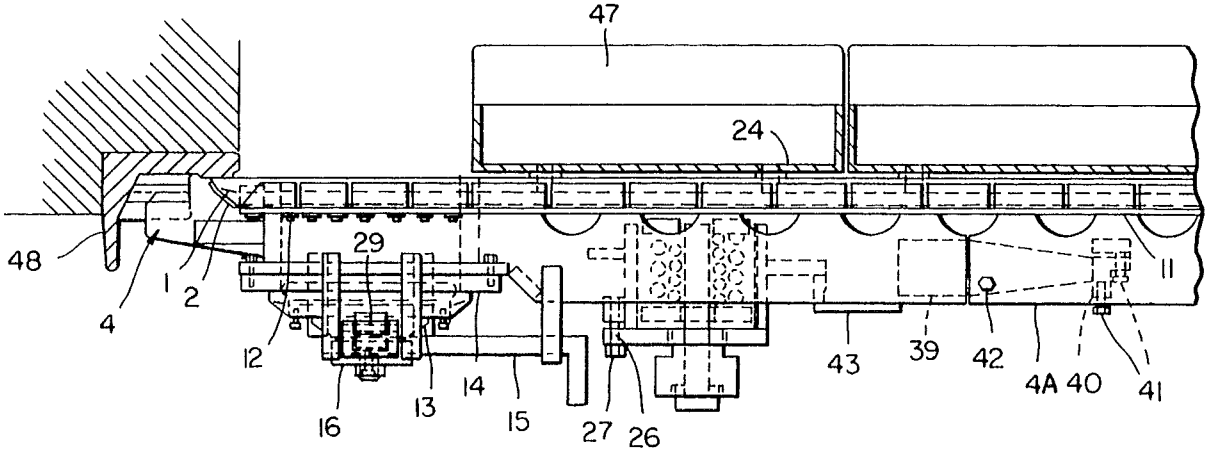
FIG. 10 is a sectional view taken along section line 10—10 on FIG. 9 illustrating further structural details of the pusher side door.
Figure 5:
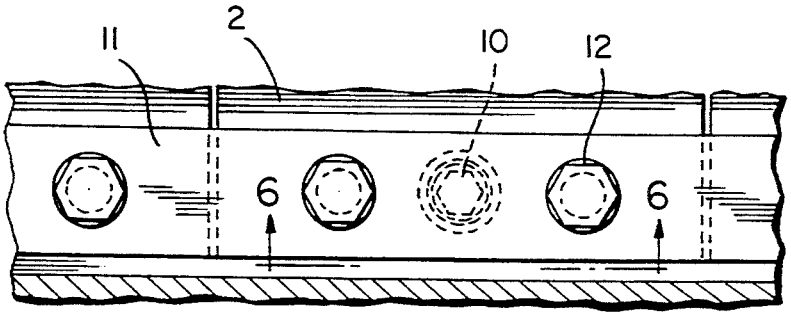
FIG. 5 is an enlarged detailed view of a portion of the diaphragm leaf spring, spring bar and bolt arrangements.
Figure 6:
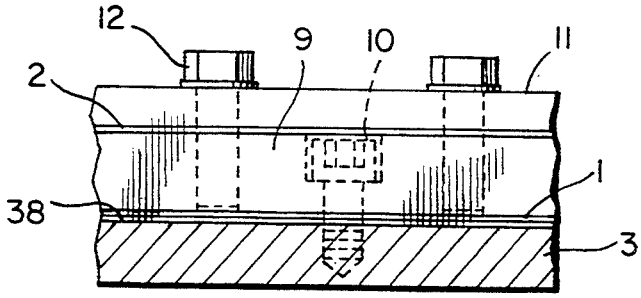
FIG. 6 is a sectional view taken substantially upon a plane passing along section line 6—6 on FIG. 5 illustrating further structural details of these components.

As illustrated in FIGS. 5 and 6, the diaphragm plate 3 includes a diaphragm bar 9 secured to the diaphragm plate 3 by diaphragm bar bolts 10. A diaphragm leaf spring bar 11 is secured to the bar 9 by diaphragm leaf spring bolts 12. The connection between the diaphragm plate 3 and the refractory 47 is illustrated in FIG. 7 and FIG. 8 illustrates the connection between the diaphragm plate 3 and the main frame weldment 4 which includes a main frame attachment stud 5 for the coke side door as illustrated in FIG. 8 and a main frame attachment bolt 6 in the pusher side door as illustrated in FIG. 12. Also, the main frame includes a guide 7 and guide bolt 8 associated therewith as illustrated in FIGS. 1, 2 and 11.

The door operates in substantially the same manner as in U.S. Pat. No. 4,186,055 with the improvements to that structure and operation with respect to both the coke side door and pusher side door being described in detail herein and illustrated in the drawings with the structure of the features common to that shown in prior U.S. Pat. No. 4,186,055 not being described nor illustrated in detail.

The foregoing is considered as illustrative only of the principles of the invention. Further since numerous modifications and changes will readily occur to those skilled in the art, it is not desired to limit the invention to the exact construction and operation shown and described, and, accordingly, all suitable modifications and equivalents may be resorted to, falling within the scope of the invention.

What is claimed as new is as follows:

1. A coke oven door mounted on a coke oven door jamb, said door comprising a main frame, means interconnecting the door with the door jamb for removably mounting the door on the door jamb, sealing means mounted on said main frame for sealing contact with the door jamb, said sealing means including a diaphragm plate mounted on the main frame, a diaphragm sealing edge mounted peripherally on the diaphragm plate and including a sealing edge engaging the face of the door jamb, and spring means mounted peripherally on the diaphragm plate and contacting the sealing edge for biasing the sealing edge toward the face of the door jamb, said spring means comprising a plurality of leaf springs providing an even application of sealing pressure on the sealing edge throughout the periphery of the diaphragm plate, said main frame including a peripheral plate extending outwardly from the main frame in generally perpendicular relation to the main frame and diaphragm plate, said peripheral plate including scalloped cutouts in the inner edge portion thereof adjacent the main frame to increase heat dissipation from the main frame and the diaphragm plate for reducing distortion/warpage of the door and frame.

2. The structure as defined in claim 1 wherein said main frame plate extends peripherally of the diaphragm plate and includes a plurality of sectional cuts to provide flexibility to the main frame, and means connected to said main frame in bridging relation to said cuts for adjusting the main frame to adjust the contour of the diaphragm plate.

3. The structure as defined in claim 2 wherein said adjusting means includes an adjustment arm having one end attached to the main frame plate and extending across a cut and manually adjusted securing and locking means for securing the other end of the adjustment arm in adjusted position on the main frame plate for flexing the main frame and diaphragm plate attached thereto to a desired configuration.

4. The structure as defined in claim 1 wherein said diaphragm plate is substantially continuous and imperforate to form a coke side door.

5. The structure as defined in claim 1 wherein said diaphragm plate is provided with an opening and a leveler door incorporated therein to form a pusher side door, said leveler door including a diaphragm plate, diaphragm sealing edge and diaphragm leaf springs duplicative of the diaphragm plate, sealing edge and leaf springs for the pusher side coke oven door.

6. A coke oven door mounted on a coke over door jamb, said door comprising a main frame, means interconnecting the door with the door jamb for removably mounting the door on the door jamb, sealing means mounted on said main frame for sealing contact with the door jamb, said sealing means including a diaphragm plate mounted on the main frame, a diaphragm sealing edge mounted peripherally on the diaphragm plate and including a sealing edge engaging the face of the door jamb, and spring means mounted peripherally on the diaphragm plate and contacting the sealing edge for biasing the sealing edge toward the face of the door jamb, said spring means comprising a plurality of leaf springs providing an even application of sealing pressure on the sealing edge throughout the periphery of the diaphragm plate, and refractory plug components secured to the surface of the diaphragm plate facing the door jamb, fastening bolts securing said components to the diaphragm plate, spacers interposed between the diaphragm plate and refractory plug components, said spacers including inwardly converging face surfaces extending from an outer periphery to the periphery of a center aperture receiving the fastener bolt to provide a seal ring around the bolt with respect to the refractory plug components and diaphragm plate.

7. A coke oven door mounted on a coke oven door jamb, said door comprising a main frame, means interconnecting the door with the door jamb for removably mounting the door on the door jamb, sealing means mounted on said main frame for sealing contact with the door jamb, said sealing means including a diaphragm plate mounted on the main frame, a diaphragm sealing edge mounted peripherally on the diaphragm plate and including a sealing edge engaging the face of the door jamb, and spring means mounted peripherally on the diaphragm plate and contacting the sealing edge for biasing the sealing edge toward the face of the door jamb, said spring means consisting only of a plurality of individual and independent leaf springs arranged in side-by-side relation around the periphery of the diaphragm plate, each individual leaf spring being in contact with the sealing edge and forming the sole means for providing an even application of sealing pressure on the sealing edge throughout the periphery of the diaphragm plate.

8. The structure as defined in claim 7 wherein said main frame includes a plate extending peripherally of the diaphragm plate in generally perpendicular relation thereto, said main frame plate including a plurality of sectional cuts to render the main frame plate flexible, said main frame plate including cutouts in an inner edge thereof and extending outwardly away from the diaphragm plate, and means connected to the main frame plate in bridging relation to each sectional cut to vary the contour of the main frame and diaphragm plate secured thereto.

9. A coke oven door adapted to be mounted on a coke oven door jamb, said door comprising:

a generally rectangular main frame having two sides and ends;

a diaphragm plate mounted on said main frame;

said main frame and diaphragm plate comprising seal mounting means;

seal means having a sealing edge and being mounted on said seal mounting means for providing a seal between said door and a door jamb, and a plurality of individual leaf springs per each said side and said end of said mainframe, arranged in end-to-end relation and circumferentially spaced about said mainframe, each said leaf spring backing said seal means and placing said sealing edge of said seal means in contact with a door jamb to provide a seal therewith when said door is closed.

10. A cook oven door adapted to be mounted on a coke oven door jamb, said door comprising:

a generally vertically oriented main frame, said main frame including a pair of parallel side plates spaced from one another transversely of a vertical extent of said main frame, said side plates being generally perpendicular to said main frame, each said side plate including a plurality of scalloped cut-outs along a length thereof adjacent said main frame and being operable to bleed off heat from said main frame thereby reducing distortion and warpage of said main frame;

a diaphragm plate mounted on said main frame;

said main frame and diaphragm plate comprising seal mounting means; and seal means mounted on said seal mounting means for providing a seal between said door and a door jamb.

11. A coke oven door adapted to be mounted on a coke oven door jamb, said door comprising:

a main frame;

a diaphragm plate mounted on said main frame;

said main frame and diaphragm plate comprising seal mounting means, seal means mounted on said seal mounting means for providing a seal between said door and a door jamb; and refractory plug components secured to said diaphragm plate by a plurality of bolts each of which passes through a spacer having a bolt receiving aperture therein, said spacers being disposed between said refractory plug components and diaphragm plate, each said spacer having opposed concave faces thereon, each said spacer providing a seal around said bolt secured therethrough and providing space between said diaphragm plate and said refractory plug components to provide flexibility when said main frame is flexed.

* * * * *